US005234441A

United States Patent [19]

Heintke et al.

[11] Patent Number: 5,234,441

[45] Date of Patent: Aug. 10, 1993

[54] EPILATING APPLIANCE

[75] Inventors: Hans-Eberhard Heintke, Wächtersbach; Gebhard Braun, Kelkheim; Walter Schäfer, Frankfurt am Main, all of Fed. Rep. of Germany

[73] Assignee: Braun Aktiengesellschaft, Kronberg, Fed. Rep. of Germany

[21] Appl. No.: 817,432

[22] Filed: Jan. 6, 1992

[51] Int. Cl.[5] ..... A45D 26/00

[52] U.S. Cl. ..... 606/133; 606/131

[58] Field of Search ..... 606/131, 133; 30/34.2; 452/82.85, 102

[56] References Cited

U.S. PATENT DOCUMENTS

| | | | |
|---|---|---|---|
| 2,592,484 | 4/1952 | Smith . | |
| 4,079,741 | 3/1978 | Daar et al. | 606/133 |
| 4,171,701 | 10/1979 | Walter et al. | 606/133 |
| 4,830,004 | 5/1989 | Alazet | 606/133 |
| 4,960,422 | 10/1990 | Demeester | 606/133 |
| 5,032,126 | 7/1991 | Cleyet et al. | 606/133 |
| 5,057,116 | 10/1991 | Zucker | 606/133 |
| 5,078,715 | 1/1992 | Daar et al. | 606/133 |
| 5,084,046 | 1/1992 | Isack | 606/133 |
| 5,084,055 | 1/1992 | Demeester | 606/133 |
| 5,112,342 | 5/1992 | Foerster et al. | 606/133 |
| 5,116,348 | 5/1992 | Gorter | 606/133 |

FOREIGN PATENT DOCUMENTS

| | | |
|---|---|---|
| 8633290 | 12/1986 | Fed. Rep. of Germany . |
| 2454283 | 4/1979 | France . |
| 2556939 | 12/1983 | France . |
| 2586538 | 8/1985 | France . |
| WO87/02556 | 5/1987 | PCT Int'l Appl. . |

*Primary Examiner*—Stephen C. Pellegrino
*Assistant Examiner*—Glenn K. Dawson
*Attorney, Agent, or Firm*—Fish & Richardson

[57] ABSTRACT

To treat small areas of the skin, to obtain neat contours and to avoid pinching the skin, the appliance which is comprised of a motor 2 contained in a casing 1, a driving device 9, 11, 13 and an expiation head 5 includes a working surface defined by the end surface of a hollow cylinder 7 (=epilation head 5). In the interior of the hollow cylinder 7, a tweezing device is provided having tweezing members 16 acted upon by a revolving cam 18.

27 Claims, 8 Drawing Sheets

EPILATING APPLIANCE

This invention relates to an epilating appliance, with a casing preferably configured as a handle and with a motor received in the casing and connected in a driving relationship with tweezing devices of at least one epilation head.

In appliances of this type known so far (FR-A1 25 56 939), the epilation head—viewed geometrically—is configured as a cylindrical barrel having its working surface formed by a narrow band of the lateral barrel surface extending parallel to the barrel axis. One disadvantage of this construction is that the skin may be dragged along the lateral barrel surface during the plucking action and may under some circumstances even be pinched in being pulled vertically to the skin surface, which is extremely painful; another disadvantage is that manipulation and guiding of the appliance are largely dictated by the direction in which it is moved. To be effective, the direction of movement should be as transversely to the barrel axis as possible. Finally, the known appliances are ill-suited for the treatment of small areas of the skin and neat contours as, for example, hair borders, upper lip area (nose), and the like.

These disadvantages are eliminated by the invention in a surprisingly simple manner. This is accomplished in that the expilation head is configured as a cylinder mounted in the casing and enclosed thereby in part, its working surface A which is placed on the skin being defined by its end surface. This means of the invention has the advantage of enabling the skin to be held "down" in a way during the plucking action which causes significantly less pain during plucking, and of permitting a working motion in small circles traveling over the skin surface which facilitates the insertion of hairs in addition to augmenting the number of hairs inserted.

In a more specified advantageous development of the invention, the cylinder is configured as a hollow cylinder accommodating in its interior the tweezing device, a cam controlling the tweezing device is provided in the geometrical axis B of the hollow cylinder, and at least one of the two components - hollow cylinder and cam - is rotatably carried in the casing and driven by the motor. This means has the advantage of permitting an enclosed and sleek structure of the expilation head allowing trouble-free manipulation.

An advantageous further development of the invention provides a simple and low-cost expilation head structure requiring little means for its execution.

In another embodiment, the locations on the skin where the plucking actions take place are continuously changed; the cam may be of reduced dimensions in the area of the circular arc determining the closing travel, making it thus possible for the overall size of the expilation head to be also reduced.

In another advantageous further development of the invention a symmetrical cam has two opposed circular sections which determine the closing position of the tweezing members and accordingly cooperate with two opposed tweezing members.

With this type of cam structure, the number of tweezing members may be at least doubled—using, for example, four tweezing members—as a result of which the number of plucking cycles increases equally.

The reduction in size of the expilation heads affords the advantage of allowing several heads, for example, two or three, to be mounted on the casing, whereby the number of plucking cycles of the epilating appliance is increased still further.

A still further possible variation has the advantage of allowing double use to be made of the motion of the tweezing members, that is, as they move into the closing position on the one side, they open an aperture for the admission of hairs on the other side. The number of plucking cycles can be substantially increased thereby.

In a further advantageous embodiment of the invention, the hollow cylinder of the epilation head and the cam have their axle or shaft slidably guided in the direction of the geometrical axis of the cylinder, and at least the hollow cylinder is provided with a return spring. These means provide the expilation head with a certain elasticity, allowing it to resiliently yield and recede into the interior of the casing when the skin contacting pressure becomes excessive.

Also disclosed are features which—applies singly, in part or jointly—serve the function of providing advantageous or useful further developments of the appliance of the invention.

Embodiments of the present invention are illustrated partly schematically in the accompanying drawings. In the drawings, FIG. 1 is a longitudinal sectional view of an epilating appliance;

Figure 1:
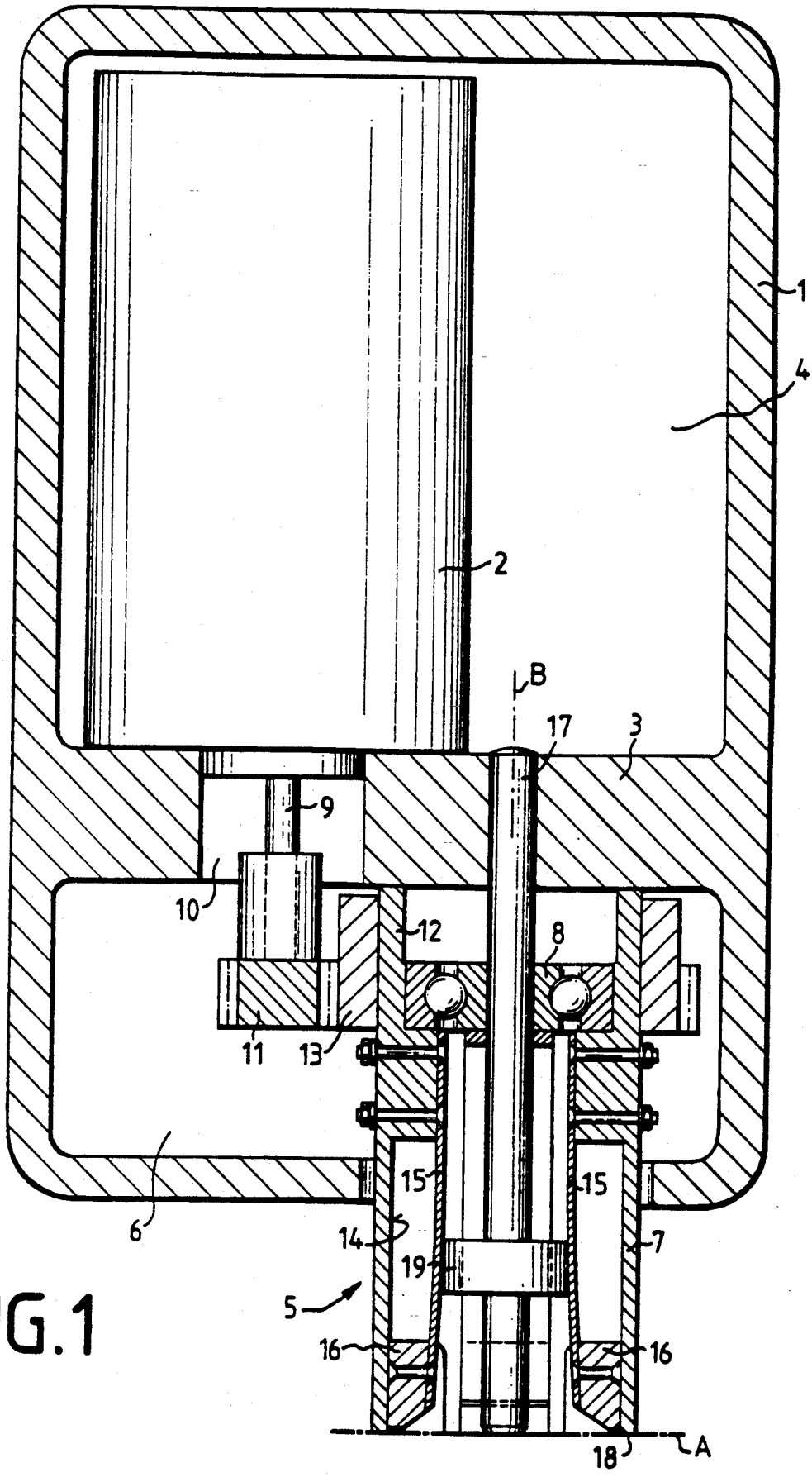

The appliance for plucking out hairs as illustrated in FIG. 1, briefly referred to as "epilating appliance", is substantially comprised of a casing 1 accommodating a motor 2 which may be an electric motor supplied with energy from primary or secondary cells or directly from the mains supply or a spring motor.

The casing 1 is configured such that it may serve as a handle for manipulating the epilating appliance. The casing 1 further includes a partition 3 separating the motor compartment 4 from a gear compartment 6 which partially encloses an expilation head 5. Rotatable carried in an antifriction bearing 8 within the gear compartment 6 is a hollow cylinder 7 which is part of the expilation head 5. A plain bearing of known construction may be substituted for the antifriction bearing 8. A pinion 11 meshing with a gear 13 mounted on the proximate end 12 of the hollow cylinder 7 is secured to the shaft 9 of the motor 2, the shaft extending into the gear compartment 6 through an opening 10 in the partition 3. The gear train 11, 13 thus provides a driving connection between the rotary hollow cylinder 7 and the motor 2. In lieu of the gear train, a continuously variable drive as known per se, such as a belt or string drive, may also be used. The transmission is to be configured such that the rotational frequency of the hollow cylinder 7 is smaller than that of the motor.

Fastened to the inner surface 14 of the hollow cylinder 7 within the gear compartment 6 on opposite sides are two leaf springs 15, carrying at their free ends tweezing members 16 which are adapted to move into abutting engagement with the associated inner surface 14 of the hollow cylinder 7, as will be set out in more detail in the following.

Mounted in the partition 3 is an axle 17 which is in parallel arrangement with the motor shaft 9, extends through the hollow cylinder 7 up to its outer rim 18 and carries a cam 19 of a structure suited to bring the tweezing members 16 into resilient abutting engagement with the inner surface 14 of the hollow cylinder 7 through the action of the leaf springs. The rim 18 of the hollow cylinder 7 which is placed on the skin during operation of the epilating appliance and which forms the end surface of the hollow cylinder 7, defines the working surface A of the expilation head 5.

Figure 2:
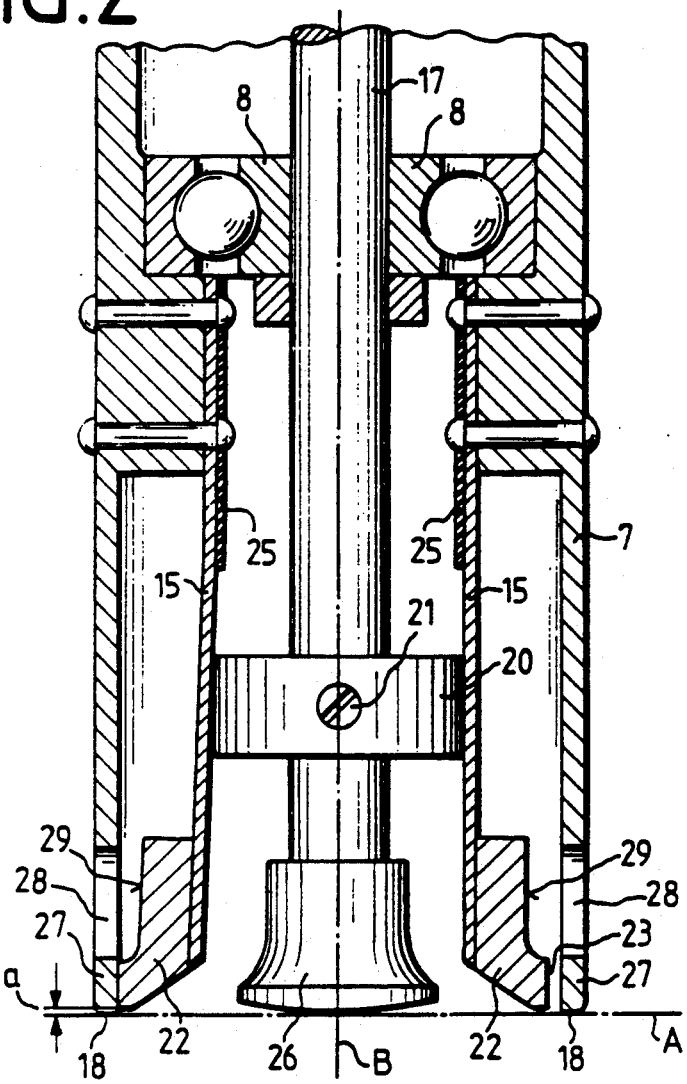
FIG. 2 is a longitudinal sectional view of an expilation head.
Figure 3:
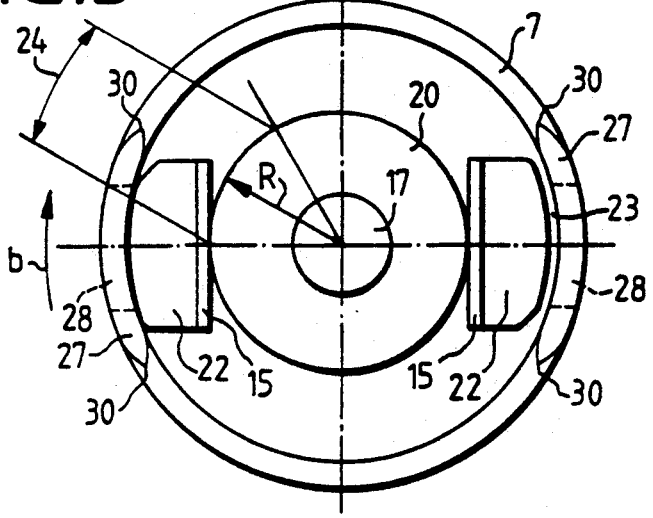
FIG. 3 is a top plan view of the expilation head of FIG. 2.

The basic mode of function of the tweezing device comprised of parts of the hollow cylinder 7 and the tweezing members 16 will become apparent from FIGS. 2 and 3, like parts having been assigned like reference numerals as in FIG. 1.

The cam 20 which, unlike the representation of FIG. 1, is an asymmetrical structure, is adjustably secured to the axle 17 by means of a set screw 21. The leaf springs 15 are configured such as to urge the tweezing members 22 mounted on their free ends into an open position, thereby producing a gap 23 between the tweezing members and the associated inner surface 14 of the hollow cylinder 7. The cam 20 is dimensioned such that a section 24 of its circumference which is of a circular configuration is capable of urging the tweezing members 22 into a closing position in which—as mentioned—the tweezing members 22 are in abutting engagement with the inner surface 14 of the hollow cylinder 7. The tweezing force of the tweezing members 22 is adjustable by displacing the cam 20 along the axle 17. To prevent vibrations of the leaf springs 15, damping strips 25 may be affixed to their located ends. The tweezing members 22 are slightly inwardly recessed relative to the rim 18 of the hollow cylinder 7—by the amount a=0.1–0.4 mm, approximately—in order to prevent pinching of the skin. Seated on the free end of the axle 17 is a head 26 having an outwardly convex surface to prevent the skin from being excessively domed into the interior of the hollow cylinder 7.

Figure 8:
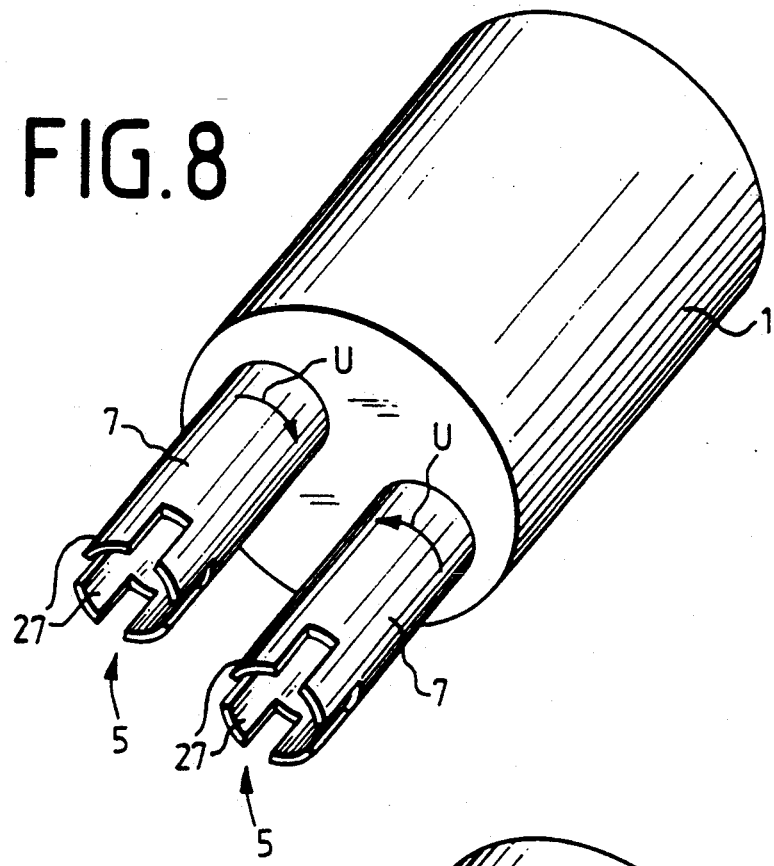
FIG. 8 is a perspective view of an epilating appliance incorporating two expilation heads illustrated schematically.
Figure 9:
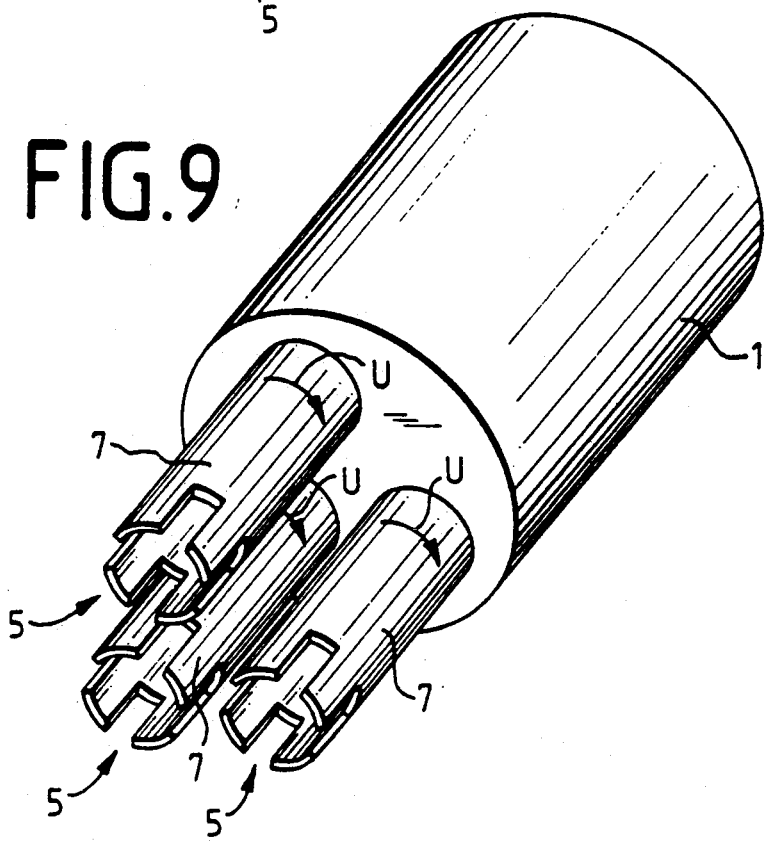
FIG. 9 is a perspective view of an epilating appliance incorporating three expilation heads illustrated schematically.

The shell of the hollow cylinder 7 has its outer edge partly indented, such that the portions 27 of the shell cooperating with the tweezing members 22 extend towards the working surface A in crenellated fashion, as becomes apparent from FIGS. 8 and 9. On these shell portions 27 apertures 28 may be provided through which plucked hairs are ejected; in this event, the tweezing members 22 are suitably provided with recesses 29 clearing the apertures 28. To facilitate the insertion of the hairs to be plucked out, the vertical edges 30 of the shell portions 27 are beveled.

The mode of function of the appliance shown in FIGS. 1, 2 and 3 is as follows:

The motor 2 is activated by means of a switch of a suitable known construction not shown, and the motor shaft 9 operates on the gear train 11, 13 to cause rotation of the hollow cylinder 7 of the expilation head 5. The expilation head 5 is then placed on the selected area of the skin with its end surface which in FIGS. 1 and 2 defines the working surface A and is moved over it using circular motions. On rotation of the hollow cylinder 7, for example, in the direction of arrow b in FIG. 3, the cam 19 or 20 will urge the tweezing members 16 or 22 secured to the hollow cylinder into the closing position as long as they are in contact with the projecting circular-arc shaped section 24 of radius R of the cam track; during the remaining part of a revolution, the tweezing members 16 or 22 will recede inwardly under the action of their leaf springs 15, thus opening the gap 23 mentioned. As a result of the circular motion of the expilation head 5 over the skin surface, the hairs will penetrate into the gap 23, they will be gripped by the tweezing members 16 or 22 as they move into the closing position, and will be plucked out of the skin as the rotation of the hollow cylinder 7 continues. In the presence of two tweezing members on the expilation head, this cycle of operations will be repeated twice for each revolution of the expilation head.

By changing the arc length of the circular section 24 of the cam track and/or the gear ratio, the closing period of the tweezing members 16, 22 and the length of the epilating travel can be varied.

Figure 4:
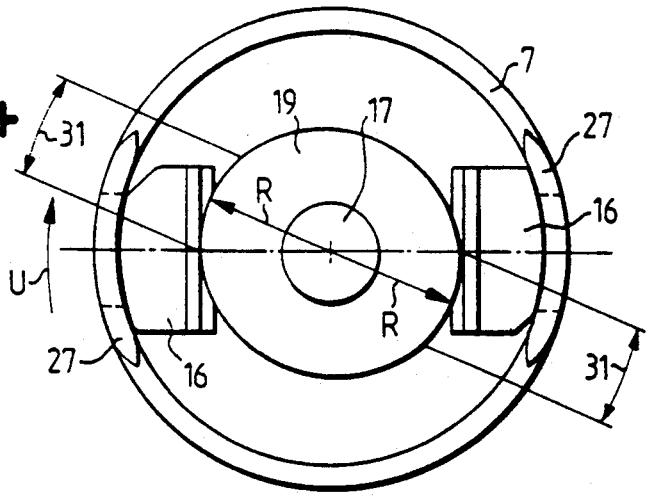
FIG. 4 is a top plan view of a first variation of the expilation head of FIG. 2.

In this application, however, asymmetrical cams as described in the foregoing have the disadvantage that they subject the axle 17 to bending stresses in alternating directions on each revolution of the hollow cylinder 7. Greater advantages are afforded by the symmetrical configuration of the cam 19 of FIG. 4, as also illustrated in FIG. 1. With the tweezing members 16 in opposed arrangement, the cam 19 is provided with two opposed circular sections 31 having the radii R of the cam track, so that in the closing position of the cam 19 no one-sided radial pressure is exerted on the axle 17. In addition, this arrangement results in as many as four closing positions of the tweezing members 16 on each revolution of the hollow cylinder 7. FIG. 4 shows the tweezing members 16 in their closing positions.

Figure 5:
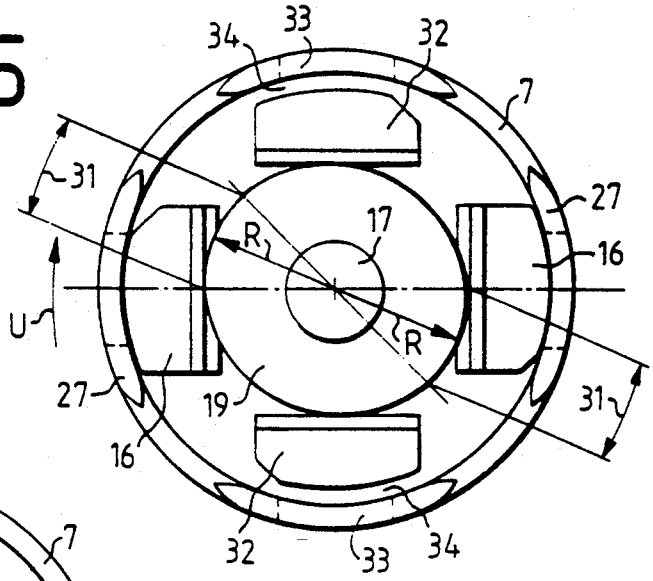
FIG. 5 is a top plan view of a second variation of the expilation head of FIG. 2.

The number of closing position can be doubled if, according to the representation of FIG. 5, two further tweezing members 32 of the same configuration and arrangement as the tweezing members 16 are provided symmetrically thereto in the free space of the hollow cylinder 7, as shown in FIG. 5. In this representation; the tweezing members 16 are in the closing position while the tweezing members 32 are in the opening position, producing a gap 34 between them and the upstanding crenellated portions 33 of the cylinder shell which are of the same construction as the corresponding portions 27. Such an arrangement results in eight closing positions on each revolution of the hollow cylinder 7.

Figure 6:
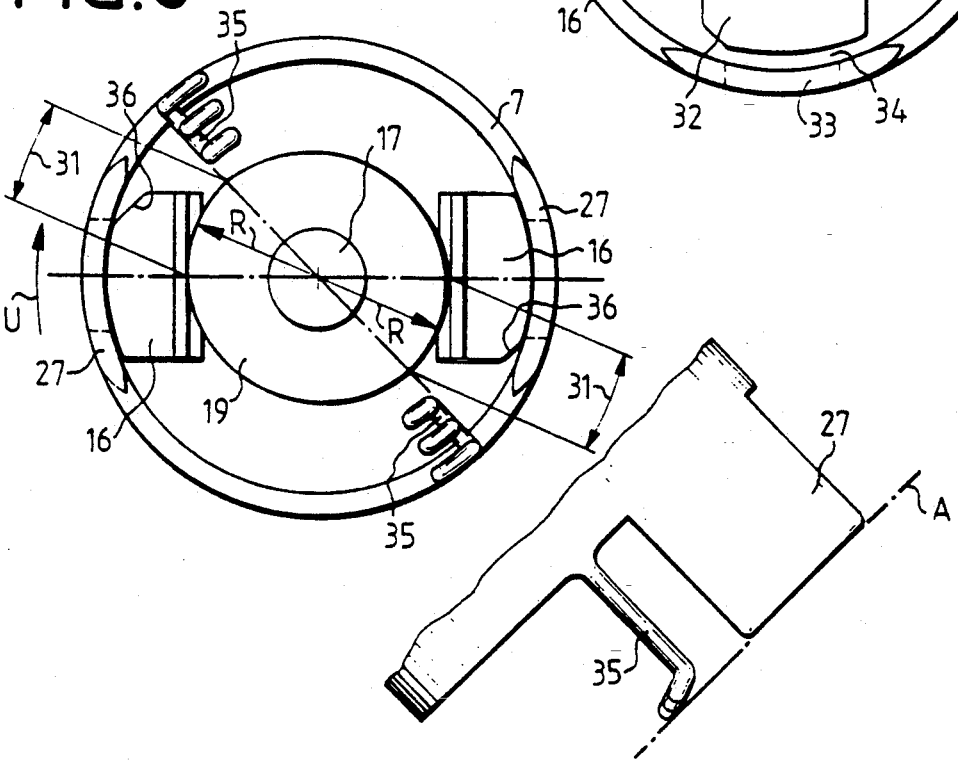
FIG. 6 is a top plan view of a third variation of the expilation head of FIG. 2.

FIG. 6 shows an expilation head in the same view as FIG. 4, however, with the added provision of a raising comb 35 located ahead of the tweezing members 16 when viewed in the direction of rotation U of the expilation head, and the tweezing members 16 may be additionally provided with a bevel 36 to facilitate insertion of the hairs raised by the comb 35 into the gap 34 (FIG. 5). The side view shown in FIG. 6 is only schematic, illustrating that the raising comb 35 extends up to the working surface A; reference numeral 27 indicates the crenellated portion of the shell of the hollow cylinder 7 which cooperates with the tweezing members 16.

Figure 7:
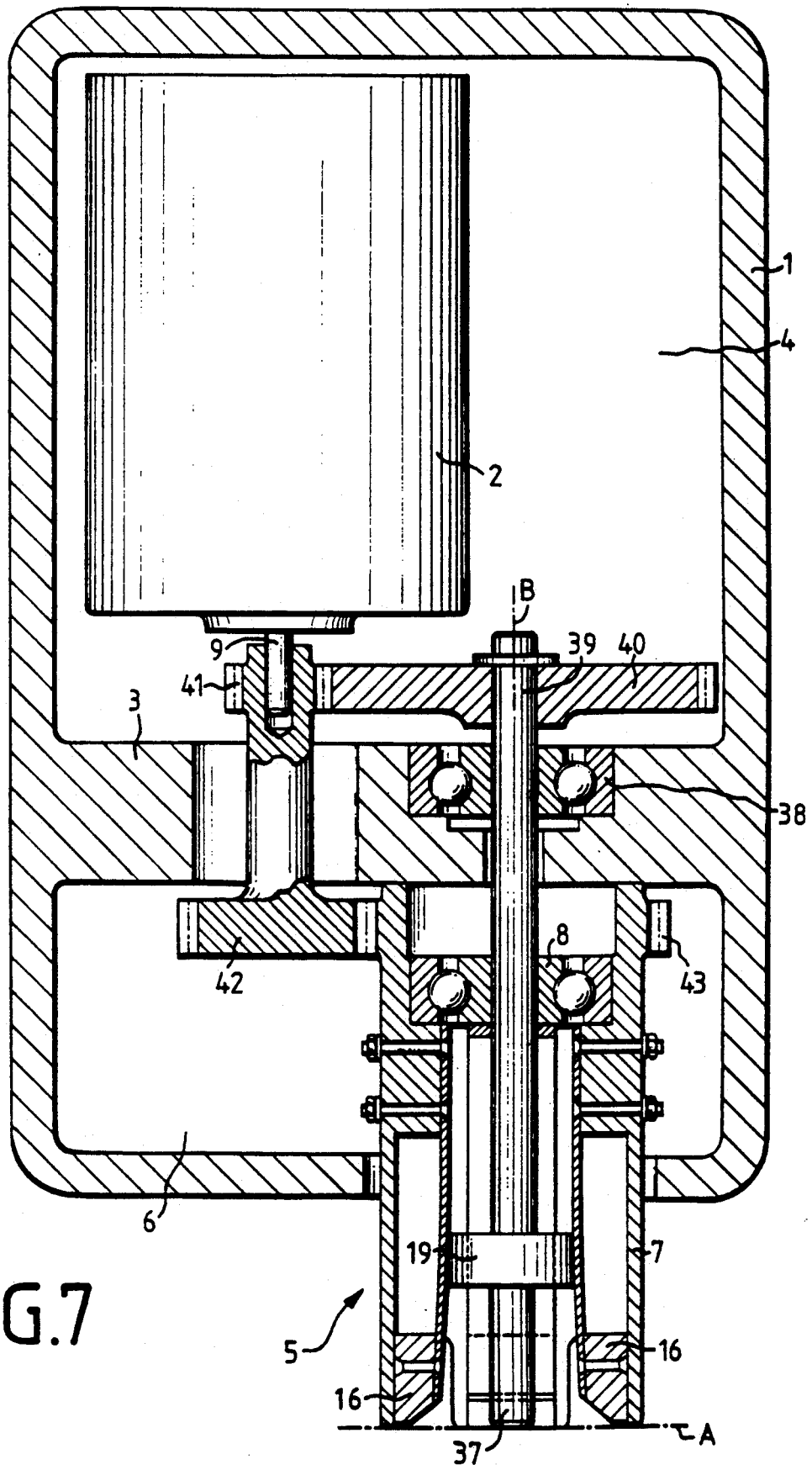
FIG. 7 is a longitudinal sectional view of a variation of the epilating appliance of FIG. 1.

FIG. 7 shows a modified detail of the epilating appliance of FIG. 1. While the appliance and its individual components are otherwise identical in construction, the cam carrier, instead of being a stationary axle, is a shaft 37 rotatable carried in the casing 2 in an antifriction bearing 38 and having at its end 39 proximate to the motor 2 a gear 40 which meshes with a second pinion 41 on the motor shaft 9; the first pinion 42 of the motor shaft 9 is connected in a driving relationship with the gear 43 of the hollow cylinder 7, as already illustrated in FIG. 1. Both gear trains 40, 41 and 42, 43 are so dimensioned and relatively coordinated that the shaft 37 with its cam 19 rotates at a smaller rotational frequency than, but in the same direction U (FIG. 4) as, the hollow cylinder 7 with the tweezing members 16 of the expilation head 5. In this arrangement, too, continuously variable drives may be substituted for the gear trains, as already indicated in FIG. 1.

Using such a rotary shaft as a cam carrier has the advantage that the cams are smaller in the area of the closing travel while the radius R is maintained unchanged—for example, the radian measure of the section 24 of the cam 19 or 20 may be halved if the shaft 37 with its cam 19 or 20 revolves at half the rotational frequency of the hollow cylinder 7. The number of plucking cycles for each revolution of the expilation head 5 is increased and the locations on the skin where the plucking actions take place shift.

The reduction in the overall size of the expilation head made possible by this means allows the provision of two adjacent epilation heads 5 with unchanged or only slightly larger suitable dimensioning, as shown in FIG. 8, with the directions of rotation U being opposed. This enables the skin to be stretched taut prior to plucking the hairs and facilitates the guiding motion of the expilation heads 5 over the skin. In FIG. 8, the expilation heads 7 are shown as hollow cylinders 7 in simplified form only, the inner components having been omitted; the crenellated portions 27 of the shell of the hollow cylinder 7 are, however, clearly recognizable.

The same applies to the epilating appliance shown in FIG. 9 which incorporates three expilation heads 5 arranged on the casing 1 in the corners of an equilateral triangle when viewed in top plan view as known per se, the heads revolving, however, in like directions of rotation U.

Figure 10:
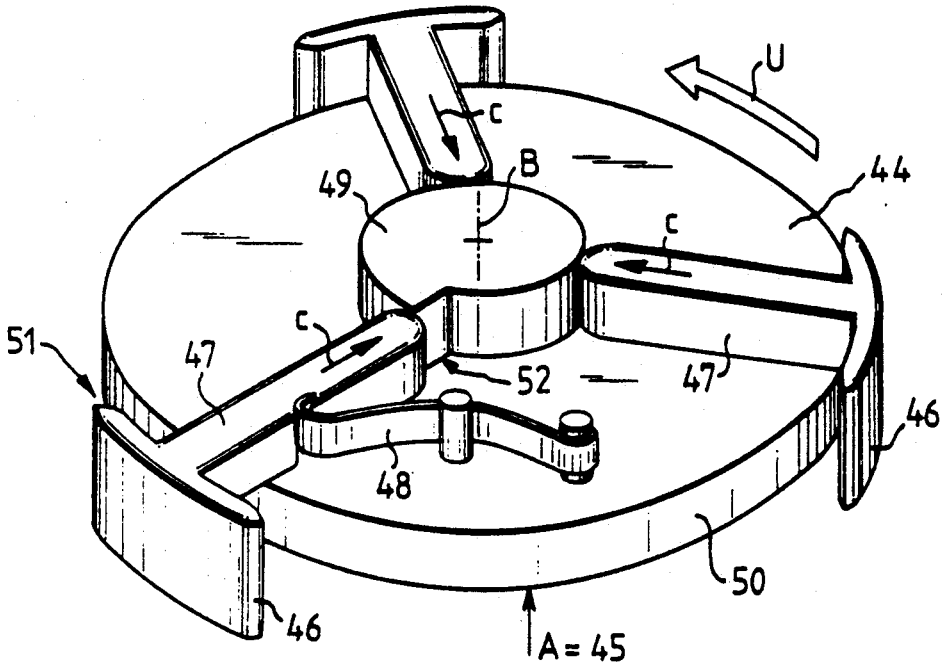
FIG. 10 is a variation of a detail of the expilation head of FIG. 1 in a perspective-schematic, fragmentary representation looking toward its inner side.

The principle of the epilation head 5 shown in FIG. 1 and the following Figures may also be reversed, as becomes apparent from FIG. 10. In this Figure, the end surface of the rotary hollow cylinder, not shown, is covered by a disk 44 which rests with its outer surface 45 defining the working surface A on the skin during the epilating operation. On the side of the disk 44 proximate to the cylinder interior, tweezing members 46 are slidably guided by means of web members 47 on which springs 48 act which, as indicated by the arrows c, urge the web members 47 with their tweezing members 46 towards the center of the disk 44 into engagement with a stationary cam 49 on the one hand, urging on the other hand the tweezing members into engagement with the outer periphery 50 of the disk 44. During each revolution of the disk 44, each tweezing member 46 is lifted clear of the associated outer periphery 50 of the disk 44 once to form a gap 51 (left part of the Figure), being abruptly returned to the closing position by the stepped portion 52 on the cam 49 (right part of the Figure).

Figure 11:
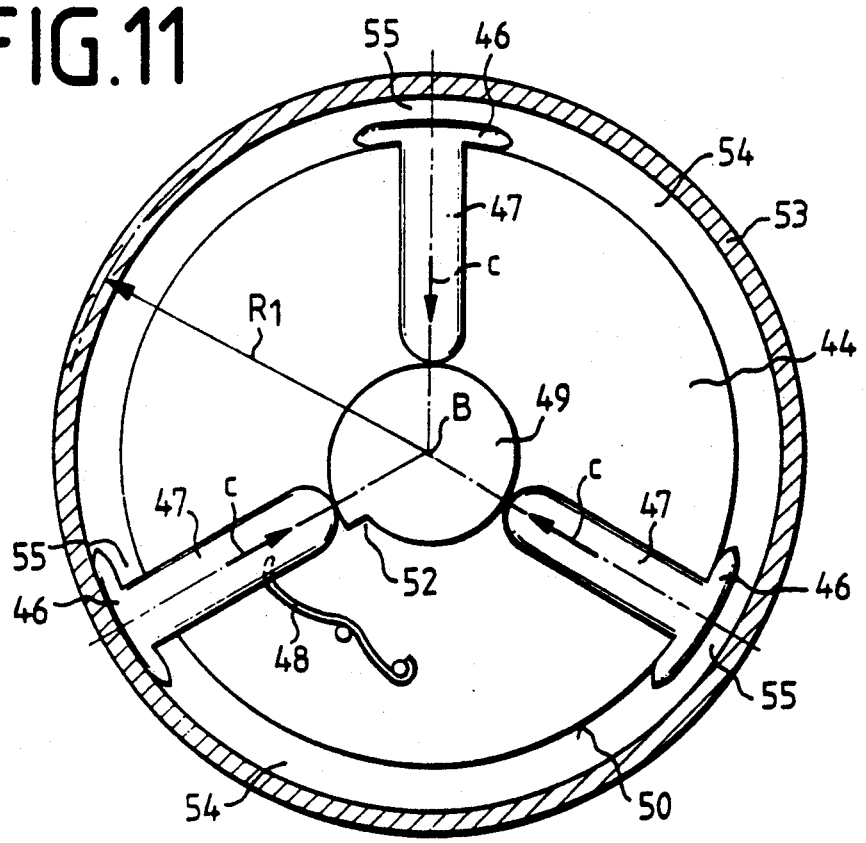
FIG. 11 is a top plan view of the variation of FIG. 10 illustrating a structural addition.

FIG. 11 shows an elaboration of this construction. A ring 53 mechanically connected with the disk 44 is placed around the disk, its radius $R_1$ being dimensioned such that a spacing 54 is maintained between the outer periphery 50 of the disk 44 and the ring 53, which spacing corresponds to the desired width of the hair entrance gap 55 taking into consideration the thickness of the tweezing members 46. By this means, any position of the tweezing member 46 is both a closed position and an open position. In the bottom left part of FIG. 11, for example, the tweezing member 46 is urged outwardly against the ring 53 by the cam 49 in opposition to the spring 48 acting in the direction of arrow c, that is, it is brought into the closing position between both components, while at the same time a gap 55 admitting hairs opens between this tweezing member 46 and the outer periphery 50 of the disk 44. In the two other positions of the tweezing members shown in the upper right-hand part of FIG. 11, the situation is reversed; here the closing position exists between the tweezing members and the outer periphery 50 of the disk 44, while the gap 55 is formed between the tweezing members and the ring 53. The variations with regard to the configuration of the cam 49 and the number and arrangement of the tweezing members 46 as indicated in the preceding Figures of the drawings may be utilized also in this construction.

Figure 12:
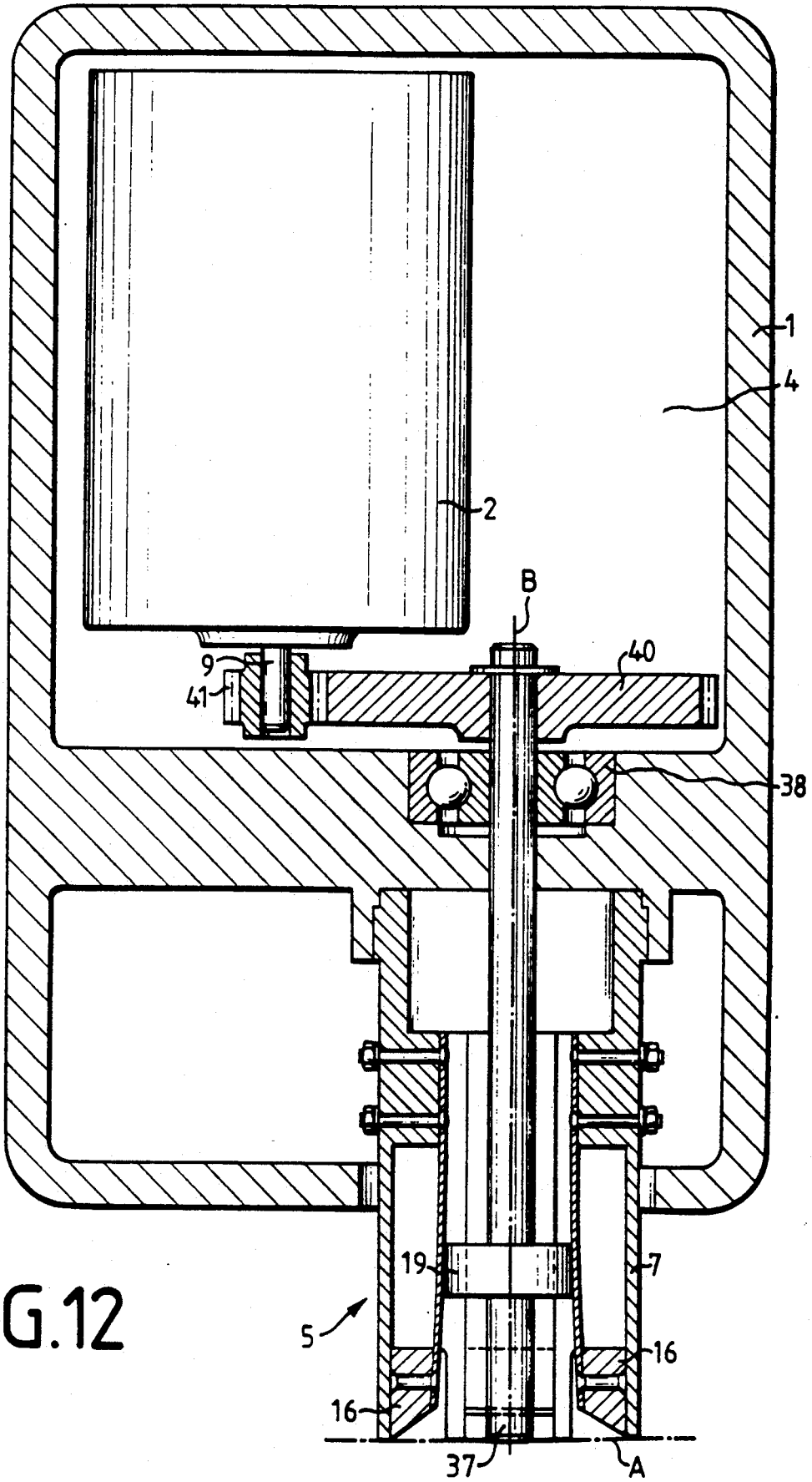
FIG. 12 is a longitudinal sectional view of a variation of the epilating appliances of FIGS. 1 and 7.

The epilating appliance 5 of FIG. 12 shows a variation of the appliance of FIG. 1; it contains elements of the epilating appliance 5 illustrated in FIG. 7. In an inversion of the relationships of FIG. 1, the hollow cylinder 7 is rigidly secured in the casing 1 and, in lieu of a rigid cam carrier, a shaft 37 on which the cam 19 is mounted is rotatable carried in the casing 1. In analogy to the embodiment of FIG. 7, a pinion 41 is seated on the shaft 9 of the motor 2, meshing with a gear 40 mounted on the shaft 37 and being thus capable of causing rotation of the shaft 37 together with the cam 19. The other relationships and the mode of operation of the expilation head 5 are otherwise identical with the embodiments indicated in FIGS. 1 and 7, with the exception of the fact that it requires the plucking operation to be performed by movement of the epilating appliance over the skin. The other variation possibilities, in particular with regard to the configuration of the cams and the number and arrangement of the tweezing members, can be utilized to a large extent.

Figure 13:
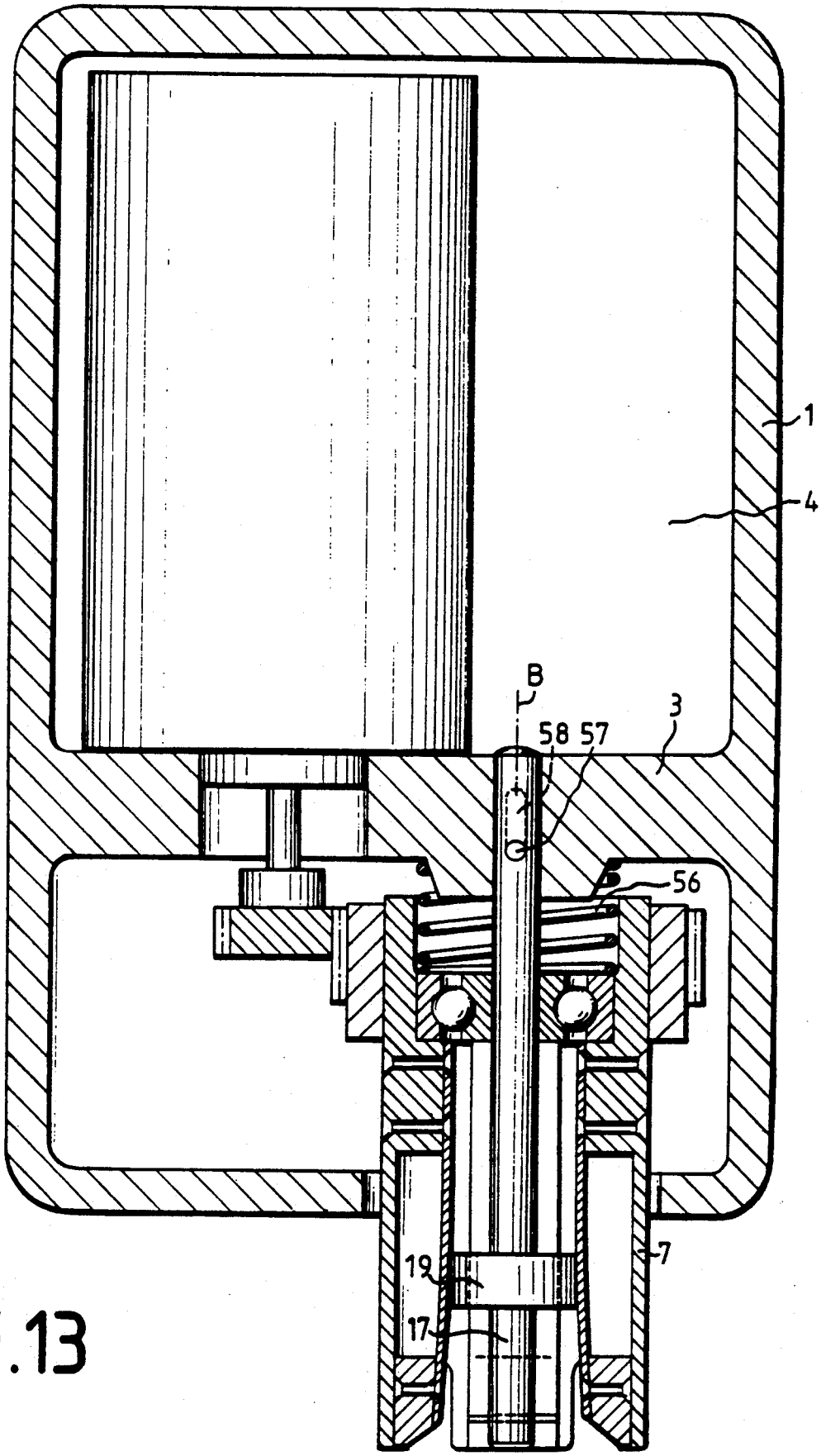
FIG. 13 is a further structural variation of the epilating appliance of FIG. 1.

In the embodiment illustrated in FIG. 13 which corresponds to the embodiment of FIG. 1 excepting the following additions, the hollow cylinder 7 in the casing 1 is arranged to be slidable into the casing interior in the direction of the geometrical axis B or the axle 17 carrying the cam 19, in opposition to the action of a return spring 56 taking support upon the partition 3 of the casing 1. The axle 17 is equally displaceable in the same direction, having for this purpose a transverse pin 57 guided in the partition 3 of the casing 1 in a slot 58 determining its displacement travel. In this manner, the entire epilation head 5 is in a position to yield resiliently in the presence of an excessive contact pressure of the epilating appliance against the skin.

We claim:

1. An epilating appliance comprising casing structure configured as a handle, at least one expilation head including cylinder structure mounted in said casing structure and enclosed thereby in part, said cylinder structure having a cylindrical surface and an end surface that is adjacent said cylindrical surface and that defines a working surface that is adapted to be placed on the skin, tweezing device structure adjacent said working surface, and motor structure in said casing structure and coupled to said tweezing device structure for cyclically moving said tweezing device structure between a first position spaced from said cylindrical surface and a second position in engagement with said cylindrical surface, so that when said working surface is placed in touch with body hair, hair is caught in a gap formed between said tweezing device structure and said cylindrical structure, and as said gap is closed by said motor structure, said hair is pulled out.

2. The appliance of claim 1 wherein said tweezing device structure includes a member that is inwardly recessed by a small amount (a) relative to said end surface of said cylinder structure.

3. The appliance of claim 1 wherein two of said epilation heads are mounted on said casing for rotation in opposite directions.

4. The appliance of claim 1 wherein three of said epilation heads are rotatable mounted on said casing in an equilateral triangle arrangement, the directions of rotation of said three heads being the same.

5. An epilating appliance comprising casing structure configured as a handle, at least one epilation head including cylinder structure mounted in said casing structure and enclosed thereby in part, said cylinder structure having a hollow shell portion, a cylindrical surface and an end surface that is adjacent said cylindrical surface and that defines a working surface that is adapted to be placed on the skin, tweezing device structure adjacent said working surface, said hollow shell portion cooperating with said tweezing device structure and extending towards said working surface (A) in crenellated fashion, and motor structure in said casing structure and coupled to said tweezing device structure for cyclically moving said tweezing device structure between a first position spaced from said cylindrical surface and a second position in engagement with said cylindrical surface, so that when said working surface is placed in touch with body hair, hair is caught in a gap formed between said tweezing device structure and said cylindrical structure, and as said gap is closed by said motor structure, said hair is pulled out.

6. The appliance of claim 5 wherein apertures are provided in said shell portion.

7. An epilating appliance comprising casing structure configured as a handle, at least one expilation head including cylinder structure mounted in said casing structure and enclosed thereby in part, said cylinder structure having a shell portion, a cylindrical surface and an end surface that is adjacent said cylindrical surface and that defines a working surface that is adapted to be placed on the skin, tweezing device structure adjacent said working surface, apertures in said shell portion, portions of said tweezing device structure lying opposite said apertures being recessed, and motor structure in said casing structure and coupled to said tweezing device structure for cyclically moving said tweezing device structure between a first position spaced from said cylindrical surface and a second position in engagement with said cylindrical surface, so that when said working surface is placed in touch with body hair, hair is caught in a gap formed between said tweezing device structure and said cylindrical structure, and as said gap is closed by said motor structure, said hair is pulled out.

8. The appliance of claim 7 wherein said shell portion includes beveled edge portions adjacent said tweezing device structure.

9. An epilating appliance comprising casing structure configured as a handle, at least one epilation head including cylinder structure mounted in said casing structure and enclosed thereby in part, said cylinder structure having a cylindrical surface and an end surface that is adjacent said cylindrical surface and that defines a working surface that is adapted to be placed on the skin, tweezing device structure including two opposed tweezing members adjacent said working surface, cam structure of symmetrical configuration that cooperates with said two opposed tweezing members, and motor structure in said casing structure and coupled to said tweezing device structure for cyclically moving said tweezing device structure between a first position spaced from said cylindrical surface and a second position in engagement with said cylindrical surface, so that when said working surface is placed in touch with body hair, hair is caught in a gap formed between said tweezing device structure and said cylindrical structure, and as said gap is closed by said motor structure, said hair is pulled out.

10. An epilating appliance comprising casing structure configured as a handle, at least one expilation head including cylinder structure mounted in said casing structure and enclosed thereby in part, said cylinder structure having a cylindrical surface and an end surface that is adjacent said cylindrical surface and that defines a working surface that is adapted to be placed on the skin, tweezing device structure including four tweezing members that are uniformly spaced about said cylindrical surface of said cylinder structure, adjacent said working surface, and motor structure in said casing structure and coupled to said tweezing device structure for cyclically moving said tweezing device structure between a first position spaced from said cylindrical surface and a second position in engagement with said cylindrical surface, so that when said working surface is placed in touch with body hair, hair is caught in a gap formed between said tweezing device structure and said cylindrical structure, and as said gap is closed by said motor structure, said hair is pulled out.

11. An epilating appliance comprising a casing configured as a handle, at least one epilation head including hollow cylinder structure mounted in said casing and enclosed thereby in part, said hollow cylinder structure having an internal cylindrical surface and an end surface that defines a working surface and is adapted to be placed on the skin, tweezing device structure secured in the interior of said hollow cylinder structure adjacent said working surface, motor structure in said casing and connected in driving relationship with a shaft in said casing, said shaft being disposed along the geometrical axis (B), and extending through said hollow cylinder structure up to said working surface (A), cam structure affixed to said shaft and acting on said tweezing device structure, said tweezing device structure being adapted to be brought into resilient abutting engagement with said internal cylindrical surface in the area of the working surface (A) by said cam structure.

12. The appliance of claim 11 and further including leaf spring structure and wherein the ends of said tweezing device structure remote from said working surface are fastened to the inner surface of said hollow cylinder by means of said leaf springs and that said cam structure acts on said leaf spring structure.

13. The appliance of claim 11 wherein said cam structure is adjustable along the axis of said cylinder structure.

14. The appliance of claim 11 and further including a head member mounted on said shaft and disposed coaxially in said hollow cylinder structure, said head member having a convex surface tangent to said working surface (A).

15. The appliance of claim 11 and further including comb structure secured to said hollow cylinder ahead of each said tweezing device structure when viewed in the direction of rotation (U), said comb structure having bent tooth structure lying approximately in the area of said working surface (A).

16. The appliance of claim 11 wherein both said hollow cylinder structure and said cam structure are slidably guided in the direction of the geometrical axis (B), and that at least said hollow cylinder structure is provided with a return spring.

17. The appliance of claim 11 wherein said hollow cylinder structure cooperating with said tweezing device structure includes a shell portion, apertures are provided in said shell portion, and portions of said tweezing device structure lying opposite said apertures are recessed.

18. The appliance of claim 17 wherein said shell portion includes beveled edges.

19. The appliance of claim 11 wherein said tweezing device structure includes a member that is inwardly recessed by a small amount (a) relative to said end, surface of said cylinder structure.

20. The appliance of claim 11 wherein said tweezing device structure includes two opposed tweezing members, and said cam structure is of symmetrical configuration and cooperates with said two opposed tweezing members.

21. The appliance of claim 11 wherein said tweezing device structure includes four tweezing members that are uniformly spaced about said cylindrical surface of said cylinder structure.

22. The appliance of claim 11, wherein two of said epilation heads are mounted on said casing for rotation in opposite directions.

23. The appliance of claim 11 wherein three of said epilation heads are rotatable mounted on said casing in an equilateral triangle arrangement, the directions of rotation of said three heads being the same.

24. An epilating appliance comprising a casing configured as a handle, hollow cylinder structure mounted in said casing and enclosed thereby in part, said hollow cylinder structure having an internal cylindrical surface and an end surface that defines a working surface and is adapted to be placed on the skin, tweezing device structure secured in the interior of said hollow cylinder structure adjacent said working surface, motor structure in said casing, a first gear train connecting said cylinder structure in driving relationship with said motor structure, a shaft rotatable carried in said casing, said shaft being disposed along the geometrical axis (B), and extending through said hollow cylinder structure up to said working surface (A), cam structure affixed to said shaft and acting on said tweezing device structure, a second gear train connecting said shaft in driving relationship to said motor structure, the gear ratios of said first and second gear trains being selected such that said shaft rotates in the same direction as, but at a smaller rotational frequency than, said hollow cylinder structure, said tweezing device structure being adapted to be brought into resilient abutting engagement with said internal surface in the area of the working surface (A) by said cam structure.

25. An epilating appliance comprising casing structure configured as a handle, hollow cylinder structure mounted in said casing structure and enclosed thereby in part, said cylinder structure having an inner surface and an end surface that defines a working surface and is adapted to be placed on the skin, a plurality of tweezing members adjacent said working surface, cam structure, motor structure in said casing and connected in driving relationship with said cam structure, leaf springs that include damping strips, the ends of said tweezing members remote from said working surface being fastened to said inner surface of said hollow cylinder structure by means of said leaf springs, and said cam structure acting on said leaf springs, said tweezing device structure being adapted to be brought into resilient abutting engagement with said cylindrical structure in the area of the working surface by said cam structure.

26. An epilating appliance comprising a casing configured as a handle, hollow cylinder structure mounted in said casing and enclosed thereby in part, said hollow cylinder structure having an end surface, a plurality of tweezing members adjacent said end surface, cam structure, motor structure in said casing and connected in driving relationship with said cam structure, a disk covering said end surface of said hollow cylinder, said disk having a radial surface and a peripheral surface, said tweezing members being radially guided on said radial surface of said disk, and springs coupled to said tweezing members to cause said tweezing members to engage said peripheral surface of said disk and to urge said tweezing members radially against said cam structure.

27. The appliance of claim 26 and further including a ring mechanically connected with said disk, the ring radius ($R_1$) exceeding the radius ($R_2$) of said disk by such an amount such that a gap admitting the hairs is maintained as said tweezing member abuttingly engages said ring and said disk in alternating sequence.

* * * * *

UNITED STATES PATENT AND TRADEMARK OFFICE

CERTIFICATE OF CORRECTION

PATENT NO. : 5,234,441

DATED : August 10, 1993

INVENTOR(S) : Hans-Eberhard Heintke et al.

It is certified that error appears in the above-indentified patent and that said Letters Patent is hereby corrected as shown below:

In the Abstract, line 4, "expiation" should be --epilation--.

Col. 2, lines 1, 17, 30-31, 32, 35, 37, 39, 43, 46, 48 and 67 "expilation" should be --epilation--;

Col. 3, lines 2 and 32, "expilation" should be --epilation--.

Col. 4, lines 10, 11, 24, 29, 31, 64 and 67-68, "expilation" should be --epilation--.

UNITED STATES PATENT AND TRADEMARK OFFICE

CERTIFICATE OF CORRECTION

PATENT NO. : 5,234,441

DATED : August 10, 1993

INVENTOR(S) : Hans-Eberhard Heintke et al.

It is certified that error appears in the above-identified patent and that said Letters Patent is hereby corrected as shown below:

Col. 5, lines 22-23, 36, 43, 44 and 49, "expilation" should be --epilation--.

Col. 6, line 46, "expilation" should be --epilation--.

Col. 7, lines 2 and 54, "expilation" should be --epilation--.

Col. 7, line 27, "rotatable" should be --rotatably--.

Col. 8, line 31, "expilation" should be --epilation--.

Col. 9, line 36, after "end" delete ",".

Signed and Sealed this

Thirteenth Day of August, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,234,441

DATED : August 10,1993

INVENTOR(S) : Hans-Eberhard Heintke et al.

It is certified that error appears in the above-identified patent and that said Letters Patent is hereby corrected as shown below:

On the title page item [22], should read -- PCT Filed: June 27, 1990 --

On the title page after item [22], insert the following PCT Information and Foreign Application Priority Data:

-- [86] PCT No.: PCT/DE90/00483
371 Date: January 6, 1992
102(e) Date: January 6, 1992

[87] PCT Pub. No.: WO91/00700
PCT Pub. No. Date: January 23, 1991

[30] Foreign Application Priority Data
July 12, 1989 [DE] Fed. Rep. Of Germany. . . . P39 22 949 --

UNITED STATES PATENT AND TRADEMARK OFFICE

CERTIFICATE OF CORRECTION

PATENT NO. : 5,234,441

DATED : August 10,1993

INVENTOR(S) : Hans-Eberhard Heintke et al.

It is certified that error appears in the above-identified patent and that said Letters Patent is hereby corrected as shown below:

Col. 1, after line 26, insert

-- From U.S. Pat. No. 2,592,484, an appliance for plucking hairs is known which is equipped with an adjustable guide plate for guiding the appliance over the skin and with a pair of tweezers driven in alternating sequence for plucking hairs, the tweezers being adapted to be brought into engagement with the skin consecutively in their working positions flush with the underside of the guide plate.

It is an object of the present invention to avoid pinching of the skin during the hair plucking operation for one thing, while for another thing manipulation and guiding of the appliance shall no longer be dictated by the direction in which the appliance is moved. Moreover, ease of insertion, reliable gripping as well as efficient plucking of the hairs to be removed shall be ensured also where relatively short hairs are involved.--.

UNITED STATES PATENT AND TRADEMARK OFFICE

CERTIFICATE OF CORRECTION

PATENT NO. : 5,234,441 Page 3 of 3

DATED : August 10, 1993

INVENTOR(S) : Hans-Eberhard Heintke et al.

It is certified that error appears in the above-identified patent and that said Letters Patent is hereby corrected as shown below:

Col.1, lines 27-29, delete "These disadvantages are eliminated by the invention in a surprisingly simple manner. This is accomplished in that the expilation", and insert --According to the invention, this requirement is satisfied in that the epilation--.

Col. 1, line 45, after "hollow cylinder", "and" should be --and/or--.

Signed and Sealed this

Fifteenth Day of June, 1999

Attest:

Q. TODD DICKINSON

Attesting Officer

Acting Commissioner of Patents and Trademarks